US011788385B2

(12) United States Patent
Hamid

(10) Patent No.: US 11,788,385 B2
(45) Date of Patent: Oct. 17, 2023

(54) PREVENTING PLUGGING OF A DOWNHOLE SHUT-IN DEVICE IN A WELLBORE

(71) Applicant: Saudi Arabian Oil Company, Dhahran (SA)

(72) Inventor: Saad Hamid, Udhailyah (SA)

(73) Assignee: Saudi Arabian Oil Company, Dhahran (SA)

( * ) Notice: Subject to any disclaimer, the term of this patent is extended or adjusted under 35 U.S.C. 154(b) by 114 days.

(21) Appl. No.: 17/194,875

(22) Filed: Mar. 8, 2021

(65) Prior Publication Data

US 2022/0282597 A1 Sep. 8, 2022

(51) Int. Cl.

| | |
|---|---|
| ***E21B 43/08*** | (2006.01) |
| ***E21B 49/08*** | (2006.01) |
| ***E21B 34/08*** | (2006.01) |
| ***E21B 47/06*** | (2012.01) |

(52) U.S. Cl.

CPC ..... *E21B 43/08* (2013.01); *E21B 34/08* (2013.01); *E21B 47/06* (2013.01); *E21B 49/0875* (2020.05)

(58) Field of Classification Search

CPC ..... E21B 33/14; E21B 33/13; E21B 47/06; E21B 47/08; E21B 49/00; E21B 43/08; E21B 2200/06

See application file for complete search history.

(56) References Cited

U.S. PATENT DOCUMENTS

| | | | |
|---|---|---|---|
| 5,375,658 | A | 12/1994 | Schultz et al. |
| 5,755,286 | A | 5/1998 | Ebinger |
| 6,220,357 | B1 | 4/2001 | Carmichael et al. |
| 6,491,104 | B1 | 12/2002 | Wilie et al. |
| 6,575,243 | B2 | 6/2003 | Pabst |
| 6,719,051 | B2 | 4/2004 | Hailey, Jr. et al. |
| 7,096,945 | B2 | 8/2006 | Richards et al. |
| 7,814,973 | B2 | 10/2010 | Dusterhoft et al. |
| 7,823,645 | B2 | 11/2010 | Henriksen et al. |
| 8,621,921 | B2 | 1/2014 | Boe et al. |
| 8,899,334 | B2 | 12/2014 | Merron et al. |
| 2004/0149435 | A1 | 8/2004 | Henderson |

FOREIGN PATENT DOCUMENTS

AU 2011341592 A1 * 6/2013 ..... E21B 43/04

OTHER PUBLICATIONS

PCT International Search Report and Written Opinion in International Appln. No. PCT/US2022/019129, dated May 23, 2022, 14 pages.

* cited by examiner

*Primary Examiner* — Zakiya W Bates
(74) *Attorney, Agent, or Firm* — Fish & Richardson P.C.

(57) ABSTRACT

A downhole shut-in device includes a valve body with an inlet. An inner sleeve is coupled to an inner surface of the valve body and moves between a closed position and an open position to control a fluid flow from the wellbore through the inlet of the valve body. The downhole shut-in device includes a screen surrounding an outer surface of the valve body to filter the particulate from the fluid flow through the inlet of the valve body to reduce a quantity of the particulate in the inlet of the valve body below a predetermined threshold quantity. A method includes identifying a production fluid flow containing particulates of a size and quantity to be filtered from entering the downhole shut-in device.

20 Claims, 6 Drawing Sheets

PREVENTING PLUGGING OF A DOWNHOLE SHUT-IN DEVICE IN A WELLBORE

TECHNICAL FIELD

This disclosure relates to a downhole shut-in device in a wellbore, for example, through which hydrocarbons are produced.

BACKGROUND

Wellbores in an oil and gas well are filled with both liquid and gaseous phases of various fluids and chemicals including water, oils, and hydrocarbon gases. The wellbore extends from a surface of the Earth downward into the formations of the Earth. The fluids and gases flow from the formations of the Earth into the wellbore and flow to the surface of the Earth through the wellbore. A downhole shut-in device coupled to a downhole test assembly can be temporarily positioned in the wellbore to test a condition of the wellbore. The downhole shut-in device actuates from an open position allowing the fluids from the wellbore into the downhole test assembly and upward to the surface to a closed position preventing the fluids and gases from the wellbore from entering the downhole test assembly.

SUMMARY

This disclosure describes technologies related to preventing plugging of a downhole shut-in device in a wellbore. Implementations of the present disclosure include a wellbore downhole shut-in device. The wellbore downhole shut-in device includes a valve body. The valve body includes an inlet. The wellbore downhole shut-in device includes an inner sleeve coupled to an inner surface of the valve body. The inner sleeve moves from a closed position to an open position to allow a fluid flow from a wellbore through the inlet of the valve body. The inner sleeve moves from the open position to the closed position to stop the fluid flow through the inlet of the valve body.

The wellbore downhole shut-in device includes an actuation mechanism coupled to the inner sleeve. The actuation mechanism operates to move the inner sleeve between the closed position and the open position. In some implementations, the actuation mechanism includes a cylinder. The actuation mechanism can include a piston positioned within the cylinder. The piston is mechanically coupled to the inner sleeve and operates to move the inner sleeve between the closed position and the open position. The actuation mechanism can include a motor operably coupled to the piston. The actuation mechanism can include a battery configured to power the motor.

The wellbore downhole shut-in device includes a screen surrounding an outer surface of the valve body. The screen filter a particulate from the fluid flow from the wellbore through the inlet of the valve body to reduce a quantity of the particulate in the inlet of the valve body below a predetermined threshold quantity. In some implementations, the screen includes multiple ribs and a wire wrap. In some implementations, the screen includes a first screen and a second screen coupled to the first screen. The first screen filters a first particulate size and the second screen filters a second particulate size. In some implementations, the particulate the screen filters particulates which have a diameter between 40 and 100 microns.

In some implementations, the wellbore downhole shut-in device includes a screen kit. The screen kit includes multiple screens to filter different particulate sizes.

The wellbore downhole shut-in device includes multiple end caps to couple the screen to the valve body and the actuation mechanism. In some implementations, the end caps include a first end cap to couple the screen to the valve body and a second end cap to couple the screen to the actuation mechanism. In some implementations, the end caps couple to a wellbore test assembly. In some implementations, the end caps accept a nipple-less lock.

Further implementations of the present disclosure include a method for maintaining an inlet of a wellbore downhole shut-in device disposed in a wellbore clear of a particulate in a fluid flow of the wellbore. The method includes receiving the fluid flow of the wellbore at a screen of a wellbore downhole shut-in device. The fluid flow includes the particulate. The wellbore downhole shut-in device includes a valve body. The valve body includes an inlet. The wellbore downhole shut-in device includes an inner sleeve coupled to an inner surface of the valve body. The inner sleeve moves from a closed position to an open position to allow a fluid flow from a wellbore through the inlet of the valve body and moves from the open position to the closed position to stop the fluid flow through the inlet of the valve body. The wellbore downhole shut-in device includes an actuation mechanism coupled to the inner sleeve. The actuation mechanism operates to move the inner sleeve between the closed position and the open position. The wellbore downhole shut-in device includes multiple end caps configured to couple the screen to the valve body and the actuation mechanism.

The screen surrounds an outer surface of the valve body. The screen filters the particulate from the fluid flow of the wellbore through the inlet of the valve body to reduce a quantity of the particulate in the inlet of the valve body below a predetermined threshold quantity.

The method includes flowing the fluid comprising the particulate through the screen. The method includes filtering the particulate with the screen. The method includes, responsive to filtering the particulate with the screen, maintaining the inlet of the valve body clear of the particulate.

Further implementations of the present disclosure include a method for identifying a production fluid flow containing particulates of a size and quantity to be filtered from entering a downhole shut-in device. The method includes identifying a production zone in a wellbore. The production zone flows a fluid containing a particulate into the wellbore. The method includes, responsive to identifying the production zone in the wellbore, identifying that the production zone of the wellbore is an unconsolidated formation.

The method includes identifying that production zone of the wellbore is an unconsolidated formation comprises determining a rock strength of the unconsolidated formation. In some implementations, the production zone is an unconsolidated formation when the rock strength of the production zone has a Young's Modulus of less than four million pounds per square inch.

The method includes responsive to identifying that the production zone is an unconsolidated formation, identifying that the production zone was hydraulically fractured and continued to produce the particulate during a flowback and cleanup operation. In some implementations, identifying that the production zone was hydraulically fractured and continued to produce the particulate during a flowback and cleanup operation includes determining that when a production rate of the particulate from the production zone is greater than 0.2 million standard cubic feet per day that the production zone was hydraulically fractured and continued to produce the particulate during a flowback and cleanup operation.

The method includes, responsive to identifying that the production zone was hydraulically fractured and continued to produce a particulate during a flowback and cleanup operation, identifying that the fluid further includes a quantity of a salt. The salt precipitates within the wellbore to produce the particulate. In some implementations, where the production zone includes an oil production zone, identifying that the fluid includes the quantity of the salt further includes determining that when a chloride concentration is greater than 100,000 milligrams per liter that the fluid further includes that the salt precipitates within the wellbore. In some implementations, where the production zone includes an oil production zone, identifying that the fluid includes the quantity of the salt, further includes determining that when an oil produced from the oil production zone is less than 20 American Petroleum Institute gravity that the salt precipitates within the wellbore.

The method includes, responsive to identifying that the production zone is an unconsolidated formation, identifying that the fluid includes a quantity of water. In some implementations, where the production zone includes a gas production zone, identifying that the fluid includes the quantity of water includes determining that when the production zone flows greater than five barrels of water per million standard cubic feet of fluid flow from the gas production zone that the fluid includes the quantity of water. In some implementations, where the production zone includes an oil production zone, identifying that the fluid includes the quantity of water includes determining that when the production zone flows includes greater than twenty percent water that the fluid includes the quantity of water.

The method includes when, responsive to either identifying that the fluid further includes the quantity of the salt or identifying that the fluid comprises the quantity of water, disposing a well test assembly in the wellbore. The well test assembly includes a sensor to sense a condition of the wellbore and transmit a signal representing a value of the condition.

The well test assembly includes a wellbore downhole shut-in device coupled to the sensor. The wellbore downhole shut-in device includes a valve body. The valve body includes an inlet. The wellbore downhole shut-in device includes an inner sleeve coupled to an inner surface of the valve body. The inner sleeve is movable from a closed position to an open position to allow a fluid flow from the wellbore through the inlet of the valve body and moveable from the open position to the closed position to stop the fluid flow through the inlet of the valve body. The wellbore downhole shut-in device includes an actuation mechanism coupled to the inner sleeve. The actuation mechanism is operable to move the inner sleeve between the closed position and the open position.

The wellbore downhole shut-in device includes a screen surrounding an outer surface of the valve body. The screen filters the particulate from the fluid flow of the wellbore through the inlet of the valve body to reduce a quantity of the particulate in the inlet of the valve body below a predetermined threshold quantity. The wellbore downhole shut-in device includes multiple end caps to couple the screen to the valve body and the actuation mechanism.

The details of one or more implementations of the subject matter described in this disclosure are set forth in the accompanying drawings and the description below. Other features, aspects, and advantages of the subject matter will become apparent from the description, the drawings, and the claims.

DETAILED DESCRIPTION

Figure 1:
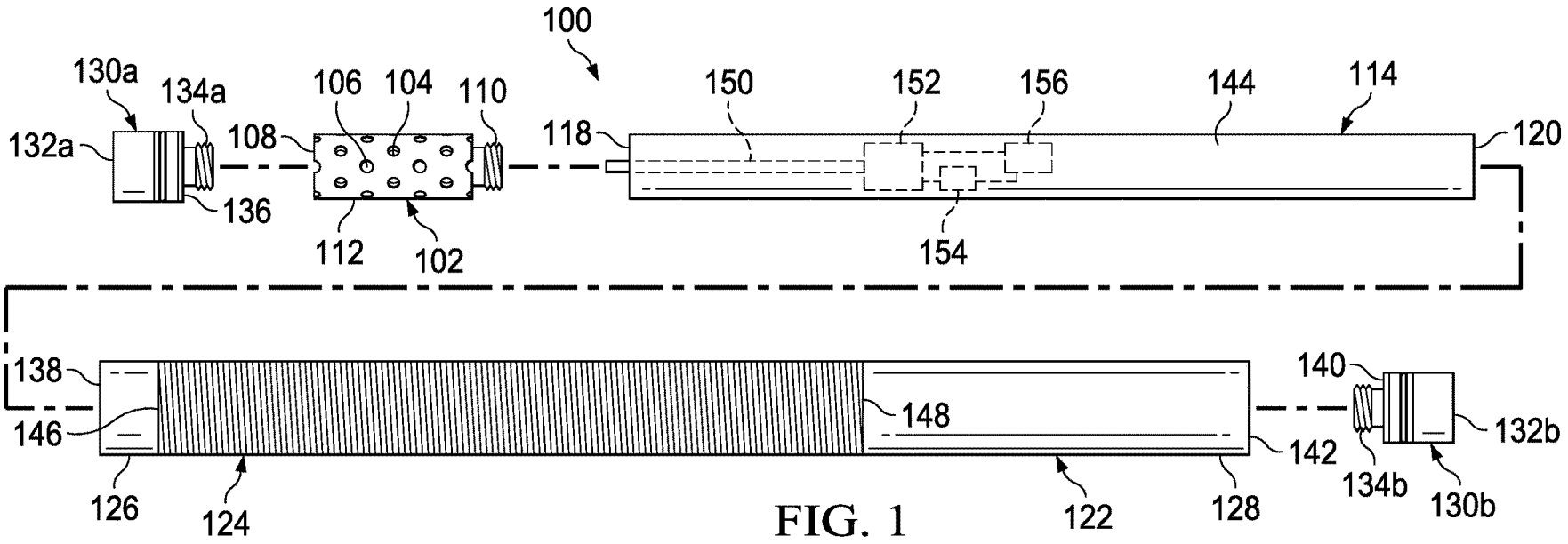
FIG. 1 illustrates an example exploded schematic view of a wellbore downhole shut-in device.

The present disclosure describes an assembly and a method for preventing plugging of a downhole shut-in device in a wellbore. The assembly includes wellbore downhole shut-in device. The wellbore downhole shut-in device includes a valve body with an inlet. The wellbore downhole shut-in device includes an inner sleeve coupled to an inner surface of the valve body. The inner sleeve moves from a closed position to an open position to allow a fluid flow from a wellbore through the inlet of the valve body and moves from the open position to the closed position to prevent the fluid flow through the inlet of the valve body. The wellbore downhole shut-in device includes an actuation mechanism coupled to the inner sleeve. The actuation mechanism operates to move the inner sleeve between the closed position and the open position. The wellbore downhole shut-in device includes a screen surrounding an outer surface of the valve body. The screen filters a particulate from a fluid flow of the wellbore through the inlet of the valve body to prevent clogging the inlet of the valve body with the particulate. The wellbore downhole shut-in device includes multiple end caps to couple the screen to the valve body and the actuation mechanism.

The method includes filtering a fluid flow of a wellbore. The wellbore includes the wellbore downhole shut-in device to control the fluid flow through the wellbore. The method includes flowing the wellbore fluid including the particulate through the screen. The method includes filtering the particulate from the wellbore fluid with the screen. The method includes, responsive to filtering the particulate from the wellbore fluid with the screen, maintaining the inlet of the valve body clear of the particulate.

A further method includes identifying a production zone in a wellbore. The production zone flows a fluid containing a particulate into the wellbore. The method includes, responsive to identifying the production zone in the wellbore, identifying that the production zone of the wellbore is an unconsolidated formation. The method includes, responsive to identifying that the production zone is an unconsolidated formation, identifying that the production zone was hydraulically fractured and continued to produce the particulate during a flowback and cleanup operation. The method includes, responsive to identifying that the production zone was hydraulically fractured and continued to produce a particulate during a flowback and cleanup operation, identifying that the fluid further comprises a quantity of a salt. The salt precipitates within the wellbore to produce the particulate. The method includes, responsive to identifying that the production zone is an unconsolidated formation, identifying that the fluid includes a quantity of water. The method includes when, responsive to either identifying that the fluid further includes the quantity of the salt or identifying that the fluid includes the quantity of water, disposing a well test assembly in the wellbore. The well test assembly incudes a sensor and the downhole shut-in device. The sensor senses a condition of the wellbore and transmit a signal representing a value of the condition. The well test assembly includes a wellbore downhole shut-in device mechanically coupled to the sensor. The wellbore downhole shut-in device includes a screen to filter the particulate from the fluid flowing into the wellbore downhole shut-in device.

Implementations of the present disclosure realize one or more of the following advantages. Operating life of the downhole shut-in device can be increased. For example, fewer particulates can abrade the sealing surfaces of the downhole shut-in device components. Abrasion of sealing surfaces of the downhole shut-in device components decreases downhole shut-in device life. Operating reliability can be increased. For example, fewer particulates can lodge in the inlets of the downhole shut-in device. When particulates lodge in the inlets of the downhole shut-in device, the downhole shut-in device can be prevented from shutting. Filtering the particulates from the fluid flow can reduce the occurrence of particles lodging in and building up in the inlets.

FIG. 1 illustrates an example exploded schematic view of a wellbore downhole shut-in device 100. The wellbore downhole shut-in device 100 can be abbreviated as DHSID. The wellbore shut-in device is temporarily positioned in a wellbore during a wellbore test as part of a downhole test assembly to allow or prevent a fluid flow form the wellbore from entering the downhole test assembly. Referring to FIG. 1, the wellbore downhole shut-in device 100 includes a valve body 102. As shown in in FIG. 1, the valve body 102 is a hollow cylinder. Alternatively, the valve body 102 can be any other geometric shape, such as an oval or rectangular. The valve body 102 is a metal. For example, the valve body 102 can be steel or aluminum. The valve body 102 includes multiple inlets 104. The inlets 104 allow a flow of fluid from a wellbore (not shown) to flow from the wellbore into the valve body 102.

The wellbore downhole shut-in device 100 includes an inner sleeve 106. The inner sleeve 106 is moveably coupled to an inner surface (not shown) of the valve body 102. The inner sleeve 106 slides relative to the valve body 102 to seal or open the inlets 104. The inner sleeve 106 moves from a closed position, as shown in in FIG. 1, to an open position (not shown) to allow a fluid flow from the wellbore through the inlets 104 of the valve body 102. The inner sleeve 106 moves from the open position to the closed position to stop the fluid flow through the inlets 104 of the valve body 102.

A portion 108 of the inner surface of the valve body 102 is internally threaded. Another portion 110 of an outer surface 112 of the valve body is externally threaded.

The wellbore downhole shut-in device 100 includes an actuation mechanism 114. The actuation mechanism 114 is mechanically coupled to the inner sleeve 106. The actuation mechanism 114 operates to move the inner sleeve 106 between the closed position and the open position. As illustrated, an inner portion 118 of the actuation mechanism 114 is internally threaded to couple to the threaded portion 110 of the valve body 102. Another portion 120 of the actuation mechanism 114 is internally threaded. Alternatively, the inner portion 118 can include a coupling mechanism such as a detent or a latch/lock assembly to couple the actuation mechanism 114 to the valve body 102.

The actuation mechanism 114 includes a cylinder 144. A piston 150 is positioned within the cylinder 144. The piston 150 is mechanically coupled to the inner sleeve 106. The piston 150 operates to move the inner sleeve 106 between the closed position and the open position. The actuation mechanism 114 includes a motor 152 operably coupled to the piston 150. The actuation mechanism 114 includes a battery 154 to power the motor 152.

The actuation mechanism 114 includes a controller 156. The controller 156 can operate the motor 152 and the piston 150 to shift the position of the inner sleeve 106 between the closed position and the open position to control flow through the inlets 104.

The controller 156 includes a computer with a microprocessor. The controller 156 has one or more sets of programmed instructions stored in a memory or other non-transitory computer-readable media that stores data (e.g., connected with the printed circuit board), which can be accessed and processed by a microprocessor. The programmed instructions can include, for example, instructions for sending or receiving signals and commands to operate the motor 152 and/or the piston 150 to shift the position of the inner sleeve 106 between the closed position and the open position to control flow through the inlets 104. The controller 156 stores values and times (signals and commands) indicating piston 150 operation and inner sleeve 106 position.

The wellbore downhole shut-in device 100 includes a screen 122. The screen 122 surrounds the outer surface 112 of the valve body 102. The screen 122 filters a particulate (shown later in FIG. 2) from a fluid flow of the wellbore through the inlet 104 of the valve body 102.

Figure 2A:
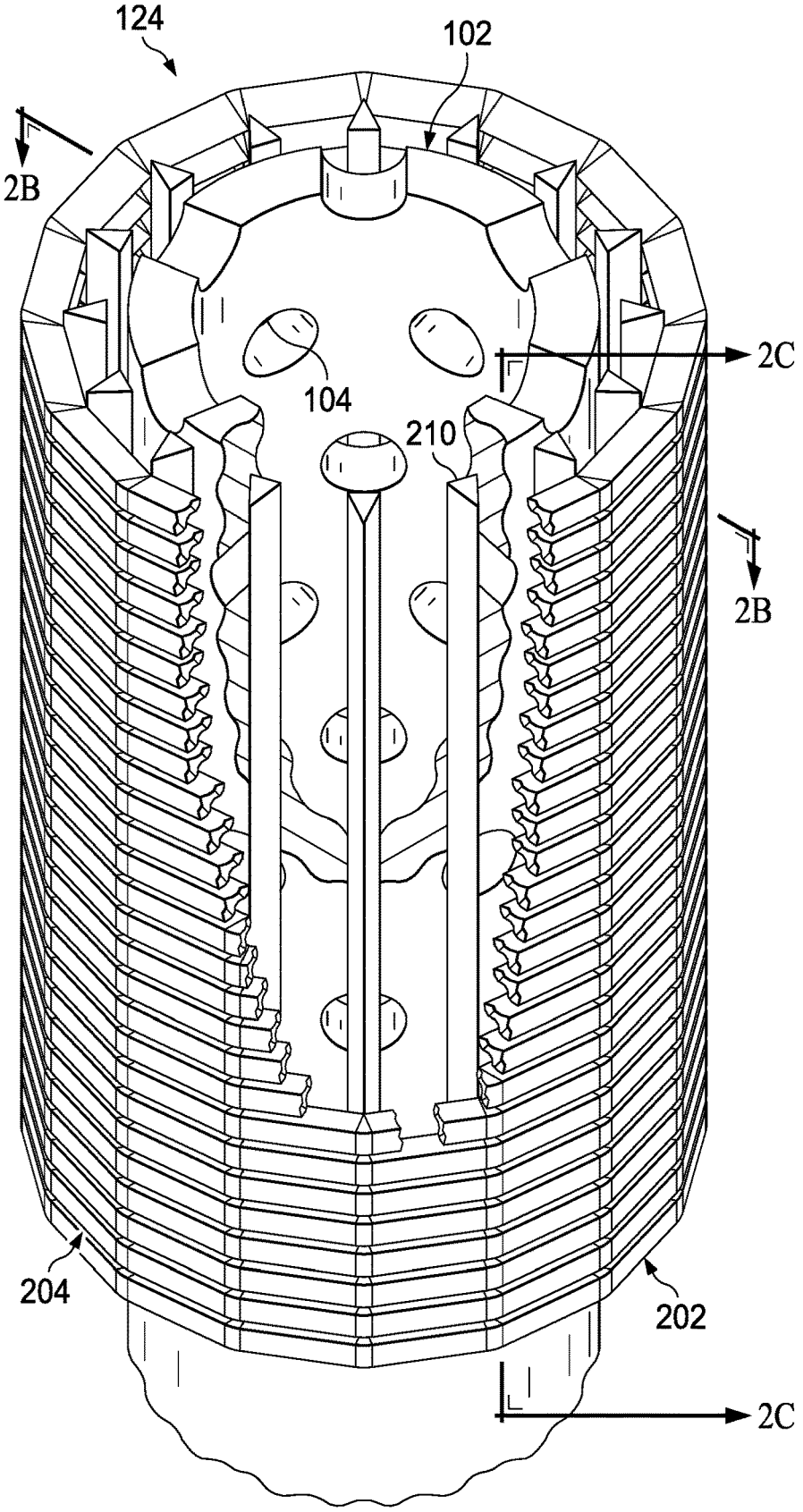
FIG. 2A illustrates an example perspective cutaway view of a screen and a valve body of the wellbore downhole shut-in device of FIG. 1.
Figure 2C:
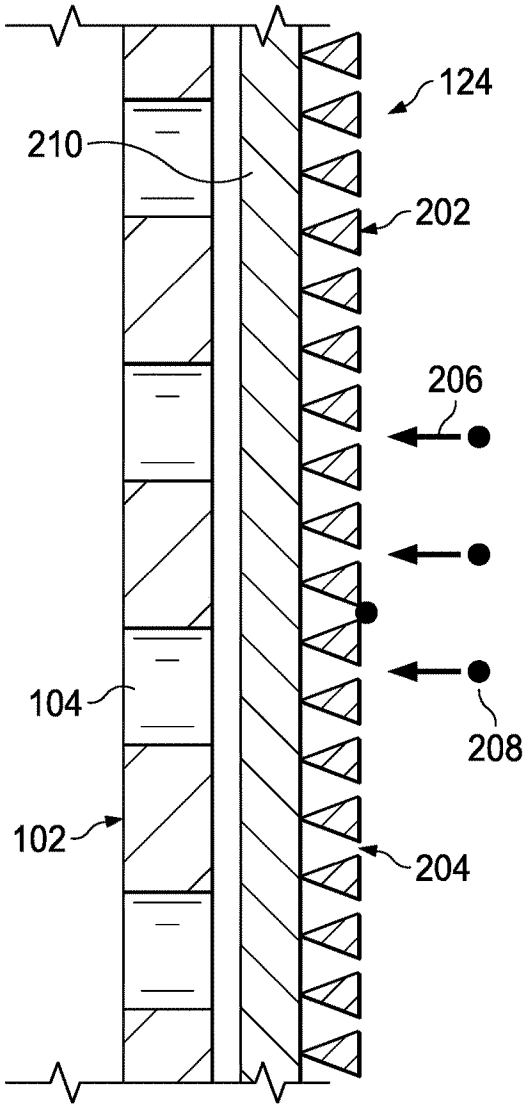
FIG. 2C illustrates an example cross-section view of the screen and the valve body of the wellbore downhole shut-in device of FIG. 1 along cross section B-B.
Figure 2B:
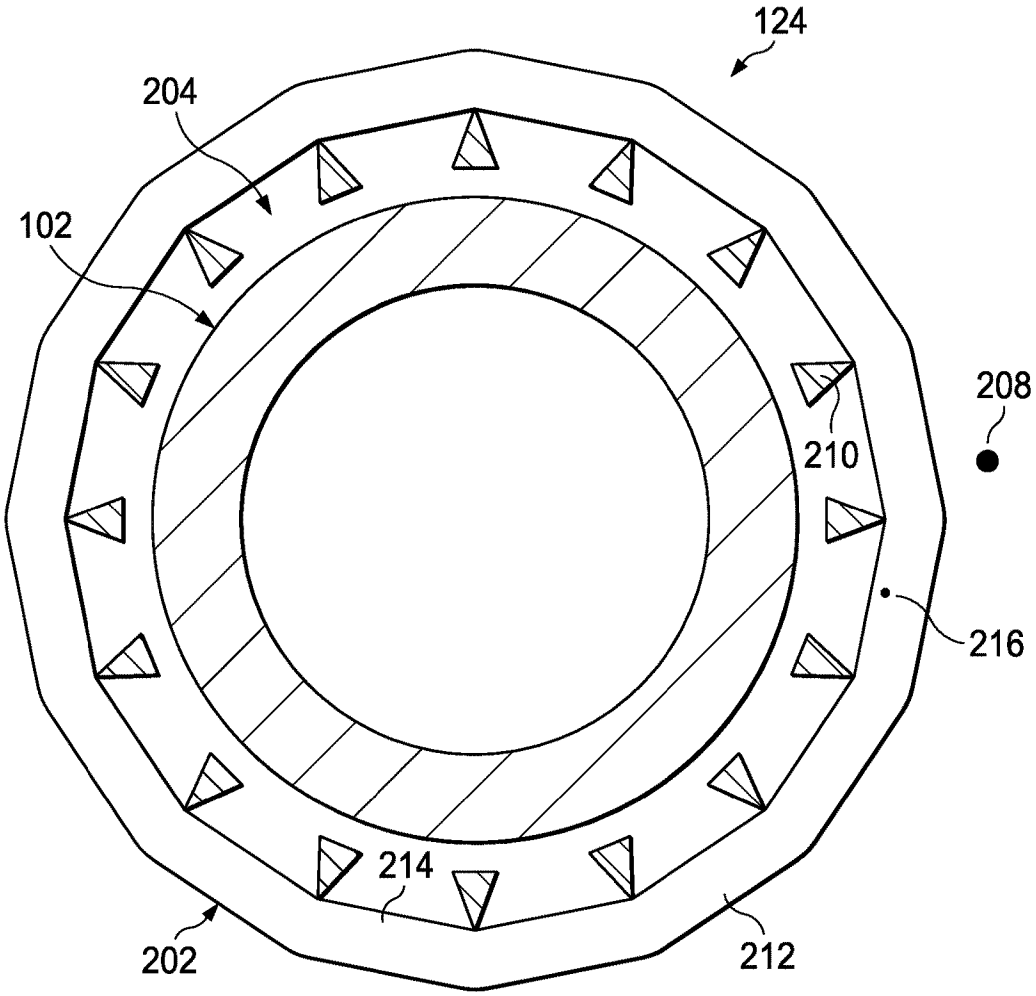
FIG. 2B illustrates an example cross-section view of the screen and the valve body of the wellbore downhole shut-in device of FIG. 1 along cross section A-A.

The screen 122 includes a screen element 124. FIG. 2A is a perspective cutaway view of a screen and a valve body of the wellbore downhole shut-in device of FIG. 1. FIG. 2B illustrates an example cross-section view of the screen and the valve body of the wellbore downhole shut-in device of FIG. 1 along cross section A-A. Other screens can be used without departing from the scope of the disclosure. FIG. 2C illustrates an example cross-section view of the screen and the valve body of the wellbore downhole shut-in device of FIG. 1 along cross section B-B. Referring to FIGS. 2A-2C, the screen element 124 is positioned surrounding the valve body 102. The inlets 104 extend through the valve body 102.

The screen element 124 includes a wire wrap 202. The wire wrap 202 is spaced to define screen openings 204. The wire wrap 202 filters a fluid flow 206. The fluid flow 206 includes particulates 208. The wire wrap 202 can be a metal or other materials without departing from the scope of the disclosure. For example, the wire wrap 202 can be steel or aluminum. The wire wrap 202 cross-sectional shape (not shown). For example, the wire wrap 202 cross-sectional shape can be v-shaped, circular, oblong, square, or rectangular. The screen openings 204 can be sized to filter the particulate 208 with a diameter between 40 and 100 microns.

The screen element 124 includes multiple ribs 210. The ribs 210 are mechanically coupled to the valve body 102 and the wire wrap 202. For example, the ribs 210 can be welded, force fit, or fastened by a fastener (such as a bolt) to the valve body 102, or fastened by a wire tie (not shown) to the wire wrap 202. The ribs 210 are positioned in between the valve body 102 and the wire wrap 202. The ribs 210 space the wire wrap 202 from the valve body 102. The ribs 210 are coupled to the wire wrap 202 as described previously, so the ribs 210 structurally support the wire wrap 202 to maintain the rigidity of wire wrap 202. This allows the fluid to flow through the screen openings 204 without collapsing the wire wrap 202. The ribs 210 can be a metal or other material without departing from the scope of the disclosure. For example, the ribs 210 can be steel or aluminum.

In some cases, the screen element 124 can include multiple screens. For example, the multiple screens can be multiple wire wraps 202. The multiple screens can be layered. Referring to FIG. 2B, the wire wrap 202 can be a first screen 212. The first screen 212 filters a first particulate size (in this case, particulate 208). A second screen 214 (a second wire wrap) can be positioned inward from the first screen 212 towards the valve body 102 and mechanically coupled to the first screen 212 and the ribs 210 as previously described. The second screen 214 filters a second particulates 216. The second particulates 216 is smaller than the first particulates 208.

Referring to FIG. 1, the screen 122 includes a first portion 126. The first portion 126 can be internally threaded. The first portion 126 is mechanically coupled to the screen element 124 at a first end 146 of the screen element 124. For example, the screen element 124 can be welded or fastened by a fastener (such as a bolt) to the first portion 126. The first portion 126 can be a metal or other material without departing from the scope of the disclosure. For example, the first portion 126 can be steel or aluminum. As shown in in FIG. 1, the first portion 126 is a hollow cylinder. Alternatively, the first portion 126 can be any other geometric shape, such as an oval or rectangular.

The screen 122 includes a second portion 128 generally similar to the first portion 126. The second portion 128 is internally threaded. The second portion 128 is also mechanically coupled to the screen element 124. For example, the screen element 124 can be welded or fastened by a fastener (such as a bolt) to the second portion 128. The second portion 128 can be a metal or other material without departing from the scope of the disclosure. For example, the second portion 128 can be steel or aluminum. As shown in in FIG. 1, the second portion 128 is a hollow cylinder. Alternatively, the second portion 128 can be any other geometric shape, such as an oval or rectangular.

Referring to FIG. 1, the wellbore downhole shut-in device 100 includes a first end cap 130*a*. The first end cap 130*a* couples the screen 122 to the valve body 102. The first end cap 130*a* includes a first portion 132*a* that is internally threaded. The first end cap 130*a* includes a second portion 134*a* that is externally threaded. A first surface 136 of the first end cap 130*a* couples to a surface 138 of the screen 122. The second portion 134*a* of the first end cap 130*a* that is externally threaded engages to the internal threads of the first portion 126 of the screen 122. The first end cap 130*a* can be a metal or other materials without departing from the scope of the disclosure. For example, the first end cap 103*a* can be steel or aluminum.

The wellbore downhole shut-in device 100 includes a second end cap 130*b*, generally similar to the first end cap 130*a*. The second end cap 130*b* couples the screen 122 to the actuation mechanism 114. The second end cap includes a first portion 132*b* that is internally threaded. The second end cap 130*b* includes a second portion 134*b* that is externally threaded. A first surface 140 of the second end cap 130*b* couples to a second surface 142 of the screen 122. The second portion 134*b* of the second end cap 130*b* that is externally threaded engages to the internal threads of the second portion 128 of the screen 122. The second end cap 130*b* can be a metal or other materials without departing from the scope of the disclosure. For example, the second end cap 103*b* can be steel or aluminum.

In some cases, the wellbore downhole shut-in device 100 includes a screen kit (not shown). The screen kit includes multiple screens (not shown) including the screen 122. Each of the screens in the screen kit can filter different particulate sizes. For example, a first screen (not shown) can filter a particulate the particulate 208 with a diameter between 60 and 100 microns. A second screen (not shown) can filter a particulate the second particulates 216 with a diameter between 40 and 60 microns. In some cases, the screen 122, the first screen, or the second screen can filter particulates smaller than 40 microns or larger than 100 microns.

Figure 3:
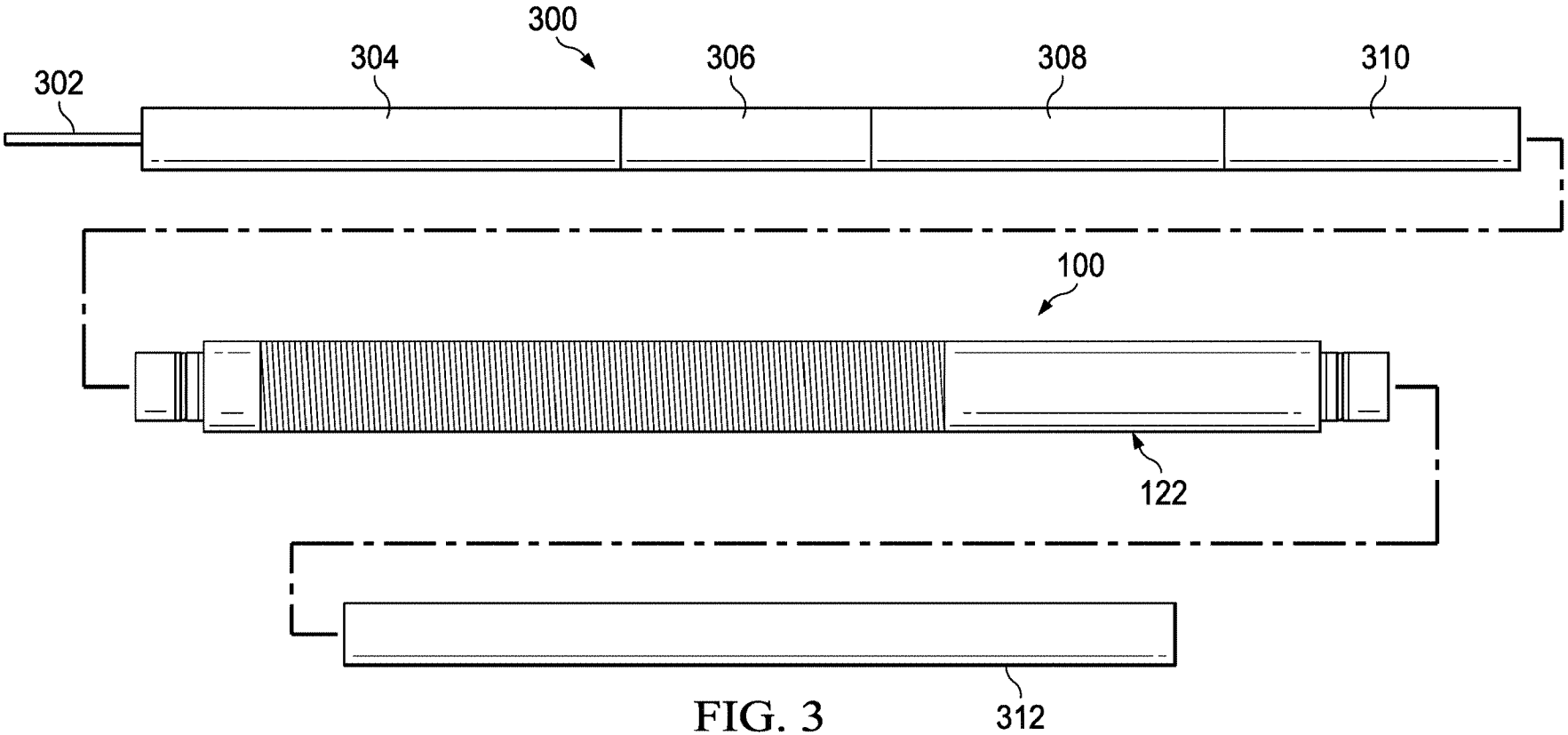
FIG. 3 illustrates an example schematic view of the wellbore downhole shut-in device incorporated into a downhole testing assembly.

FIG. 3 illustrates an example schematic view of the wellbore downhole shut-in device incorporated into a downhole testing assembly. Referring to FIG. 3, the well test assembly 300 is disposed in a wellbore (not shown) to test a condition of the wellbore. The condition can be, for example, a pressure, a temperature, or a flow rate of a fluid in the wellbore. The well test assembly 300 includes a downhole conveyor 302 to conduct the well test assembly 300 into the wellbore from the surface of the Earth. The downhole conveyor 302 can be a wireline or a slickline.

The well test assembly 300 includes a logging head 304 to mechanically and electrically couple the downhole conveyor 302 to the remaining components of the well test assembly 300.

The well test assembly 300 includes a casing collar locator 306. The casing collar locator 306 is mechanically coupled to the logging head 304. The casing collar locator 306 is a logging tool that locates a casing joint based on a magnetic signal. The casing collar locator 306 is used to determine the location of the well test assembly 300 in the wellbore relative to a casing joint.

The well test assembly 300 includes an electronic plug setting tool 308. The electronic plug setting tool 308 is mechanically coupled to the casing collar locator 306. The electronic plug setting tool 308 actuates plugs (not shown) to engage the wellbore to seal a first portion of the wellbore from a second portion of the wellbore.

The well test assembly 300 includes a nipple-less lock 310. The nipple-less lock 310 is coupled to the electronic plug setting tool 308. The nipple-less lock 310 actuates to engage the wellbore to anchor the well test assembly 300 in the wellbore.

The well test assembly 300 includes the wellbore downhole shut-in device 100. The wellbore downhole shut-in device 100 is coupled to the nipple-less lock 310. The wellbore downhole shut-in device 100 actuates from the open position allow the fluid flow from the wellbore into the valve body 102 to the closed position stopping the fluid flow form the wellbore into the valve body 102 (as shown in FIGS. 1 and 2A-2C). The wellbore downhole shut-in device 100 includes the screen 122 to filter the particulates from the wellbore fluid. Filtering the particulates from the wellbore fluid reduces the size and the quantity of the particulates in the inlet of the valve body below a predetermined threshold. Below the predetermined threshold, the size and quantity of the particulates may not clog the inlet of the valve body, allowing the wellbore downhole shut-in device 100 to actuate as previously described. The predetermined threshold size and quantity of the particulates to be filtered is used to select the screen size and opening size as described later to perform the wellbore test.

The well test assembly 300 includes a downhole memory gauge 312. The downhole memory gauge 312 is coupled to the wellbore downhole shut-in device 100. The downhole memory gauge 312 is a sensor that senses and records a wellbore pressure.

The wellbore pressure is measured using the well test assembly 300 using the following test procedure. First, the well test assembly 300 is configured for the test procedure and then placed at the target depth in the wellbore. While on the surface of the Earth, the controller 156 is programmed to open and close the wellbore downhole shut-in device 100 according to the test schedule shown in Table 1 DHSID Test Schedule.

TABLE 1

DHSID Test Schedule

| Step | Test Name | DHSID Inlet Condition (Open/Closed) | Duration (hours) |
|---|---|---|---|
| 1 | Flow-1 | Open | X1 (>0) |
| 2 | Shut in-1 | Close | Y1 (>=0) |
| 3 | Flow-2 | Open | X2 (>0) |
| 4 | Shut in-2 | Close | Y2 (>0) |
| 5 | Repeat 3-4 for multiple times | — | |
| 6 | End of Test | Open | |

Proper operation of the wellbore downhole shut-in device 100 is tested by performing one full cycle of the DHSID Test Schedule as shown in FIG. 1. Movement of the inner sleeve 106 between the open position and the closed position is verified. The wellbore downhole shut-in device 100 is then positioned with the screen 122 and secured in place with the end caps 130*a* and 130*b*. The downhole memory gauge 312 is mechanically coupled to the wellbore downhole shut-in device 100 threading into the second end cap 130*b*. The nipple-less lock 310 is mechanically coupled to the wellbore downhole shut-in device 100. The electronic plug setting tool 308 is mechanically coupled to the nipple-less lock 310. The casing collar locator 306 is mechanically coupled to the electronic plug setting tool 308. The logging head 304 is mechanically coupled to the casing collar locator 306.

A depth correction measurement is performed by checking a plug seal (not shown) depth against the depth of a tubing hanger (not shown) of the wellbore. The depth correction measurement is recorded. The wellbore includes a wellhead assembly (not shown) with a blowout preventer assembly (not shown) and a wellhead crown valve (also not shown) at the surface of the Earth. A lubricator (not shown) is coupled (stabbed) into a blowout preventer assembly coupled to the wellbore at the surface of the Earth. The downhole conveyor 302 is coupled to the logging head 304 and the now fully assembled well test assembly 300 is positioned to enter the wellbore through the blowout preventer assembly. A hanging weight of the well test assembly 300 is measured and recorded. The well test assembly 300 is positioned to contact (tag) a stuffing box coupled to the blowout preventer assembly. The wellhead crown valve is opened. An initial pressure of the wellbore at the wellhead is measured and recorded.

The well test assembly 300 is run into the wellbore by the downhole conveyor 302. The well test assembly 300 is run past (deeper than the) setting depth (the test location in the wellbore), then picked up to the setting depth so the downhole conveyor 302 is in tension. The final pick up weight of the well test assembly 300 is measured and recorded. The nipple-less lock 310 is set (engaged to the wellbore) with the well test assembly 300 at the target setting depth. Setting the nipple-less lock 310 decouples the nipple-less lock 310 from the electronic plug setting tool 308, the casing collar locator 306, the logging head 304, and the downhole conveyor 302, leaving the wellbore downhole shut-in device 100 and the downhole memory gauge 312 in the wellbore.

A pull test is performed after weight loss is observed to ensure that seals of the nipple-less lock 310 are set. The electronic plug setting tool 308, the casing collar locator 306, and the logging head 304 are picked up off the nipple-less lock 310 by the downhole conveyor 302, then run back in the wellbore in a downward direction to gently tag the top of nipple-less lock 310. The electronic plug setting tool 308, the casing collar locator 306, and the logging head 304 are picked up off the nipple-less lock 310 by the downhole conveyor 302 and pulled out of the wellbore and disassembled.

Now that the well test assembly 300 has been configured for the pressure test procedure and placed at the target depth in the wellbore, the wellbore downhole shut-in device 100 is used to pressure test the wellbore by operating the wellbore downhole shut-in device 100 as shown in Table 1. The opening and closing of wellbore downhole shut-in device 100 is monitored to confirm that the inner sleeve 106 moving from the open position to the closed position. When the inner sleeve 106 is in the closed position, the wellhead pressure and flow of fluids from the formations decreases, which confirms the wellbore downhole shut-in device is closed. The wellbore is shut in at surface after confirmation that the wellbore downhole shut-in device 100 is in the closed position. The wellbore pressure at the surface is recorded and monitor for one hour for confirmation that there is no increase in wellbore pressure at the surface. When wellbore pressure increases at the surface after initial close cycle, it may indicate a leak in the wellbore downhole shut-in device 100 may be occurring.

After each shut in cycle, the wellbore downhole shut-in device 100 will equalize pressure before the valve is fully open. This can take 1-2 hours depending on differential pressure and gas or liquid in the wellbore. Before commencing the second flow rate and any subsequent flow rate, the wellhead pressure is monitored to confirm that the wellbore downhole shut-in device 100 is open. Once the shut in pressure is equal to the previously recorded shut in pressure at the beginning of test procedure, this will indicate that the wellbore downhole shut-in device 100 is open. The choke in the wellhead assembly is opened during the flow periods. Steps 1-4 of Table 1 are repeated for the every shut in and flow cycle. The downhole memory gauge 312 records the changes in pressure of the fluid in the wellbore flowing from the formations in to the wellbore.

During the opening and closing cycles of the wellbore downhole shut-in device 100, the formation flow containing the particulates 208 can build up and clog the inlets 104, preventing the inner sleeve 106 from moving from the open position to the closed position or the closed position to the open position, resulting in a test failure. The screen 122 captures or filters the particulates 208 from the fluid flow, reducing the particulates below the threshold quantity where the inner sleeve can still move from the open position to the closed position or the closed position to the open position as previously described.

Once the pressure test using the wellbore downhole shut-in device 100 and the downhole memory gauge 312 is complete, the nipple-less lock 310, the wellbore downhole shut-in device 100, and the downhole memory gauge 312 are retrieved from the wellbore. The nipple-less lock 310, the wellbore downhole shut-in device 100, and the downhole memory gauge 312 are retrieved from the wellbore by first setting up the downhole conveyor 302. A lock pulling tool (not shown) is mechanically coupled to the downhole conveyor 302. The lubricator is coupled to the wellhead assembly. The downhole conveyor 302 and the lock pulling tool is suspended above the wellhead assembly. The hanging weight of the downhole conveyor 302 and the lock pulling tool is recorded. The downhole conveyor 302 and the lock pulling tool are positioned to enter the wellbore through the wellhead assembly. The downhole conveyor 302 and the lock pulling tool moved to contact the wellhead assembly. The crown valve of the wellhead assembly is opened and the wellhead shut in pressure is recorded.

The lock pulling tool is transported into the wellbore by the downhole conveyor 302. Before the lock pulling tool contacts the nipple-less lock, the lock pulling tool movement is stopped. The downhole conveyor 302 pulls up on the lock pulling tool. The pick up weight of the downhole conveyor and the lock pulling tool is recorded. The lock pulling tool is then moved to contact the nipple-less lock 310 by the downhole conveyor 302. When the lock pulling tool contacts the nipple-less lock 310, the lock pulling tool latches on to the nipple-less lock 310. The lock pulling tool and the nipple-less lock 310 are now mechanically coupled together.

The downhole conveyor 302 picks up the lock pulling tool, the wellbore downhole shut-in device 100, and the downhole memory gauge 312 at a weight over the original pull up weight to confirm a proper latch and engagement between the lock pulling tool and the nipple-less lock 310. The pull weight of the downhole conveyor 302 is returned to the normal pull up weight. The plug (not shown) in the wellbore is released by a plug retrieval tool. The downhole conveyor 302 then retrieves the lock pulling tool, the wellbore downhole shut-in device 100, and the downhole memory gauge 312 to the surface of the Earth. The downhole conveyor 302, the lock pulling tool, the wellbore downhole shut-in device 100, and the downhole memory gauge 312 are disassembled. The pressure data is retrieved data from downhole memory gauge 312.

Figure 4:
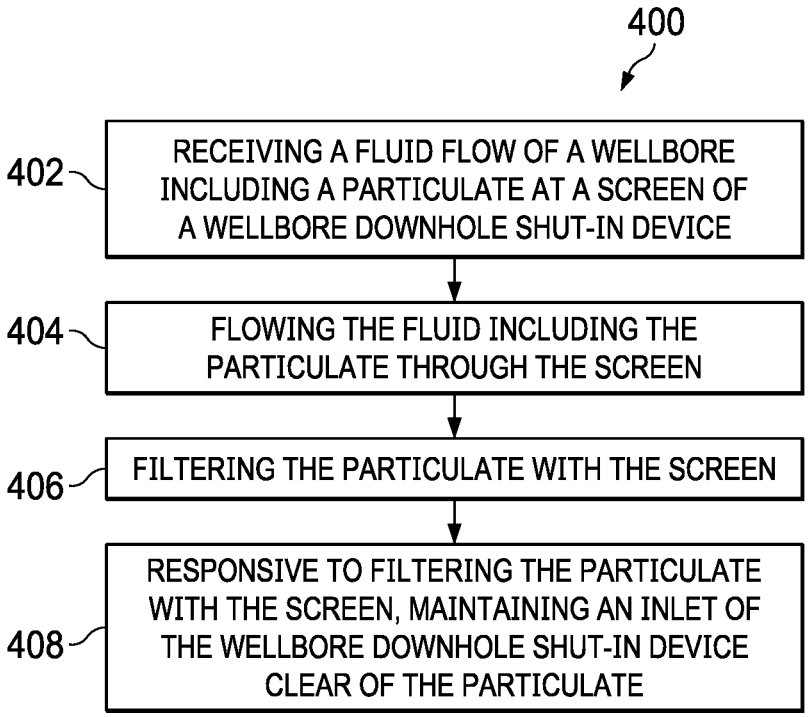
FIG. 4 illustrates a flow chart of an example method for filtering a wellbore fluid flow into a wellbore downhole shut-in valve.

FIG. 4 illustrates a flow chart of an example method for filtering a wellbore fluid flow into a wellbore downhole shut-in valve. At 402, a fluid flow of a wellbore is received at a screen of a wellbore downhole shut-in device. The fluid flow includes a particulate. The wellbore downhole shut-in device includes the screen, a valve body, an inner sleeve, an actuation mechanism, and multiple end caps. The valve body includes an inlet. The inner sleeve is coupled to an inner surface of the valve body. The inner sleeve is movable from a closed position to an open position to allow a fluid flow from a wellbore through the inlet of the valve body and moveable from the open position to the closed position to prevent the fluid flow through the inlet of the valve body. The actuation mechanism is coupled to the inner sleeve. The actuation mechanism is operable to move the inner sleeve between the closed position and the open position. The end caps couple the screen to the valve body and the actuation mechanism. The screen surrounds an outer surface of the valve body. The screen filters the particulate from the fluid flow through the inlet of the valve body.

At 404, the fluid including the particulate is flowed through the screen. As previously described in reference to FIGS. 2B and 2C, the fluid flow 206 containing the particulates 208 flows toward the screen element 124. The fluid flow 206 can contain the particulates 208 and the particulates 216 of different sizes.

At 406, the particulate is filtered with the screen. As previously described in reference to FIGS. 2A-2C, the particulates 208 and the particulates 216 are filtered by the wire wrap 202. The wire wrap 202 can be multiple screens. The first screen 212 filters the first particulate size (in this case, particulates 208). The second screen 214 (a second wire wrap) can be positioned inward from the first screen 212 towards the valve body 102 and coupled to the first screen 212 and the ribs 210 to filter the second particulates 216 smaller than the first particulates 208.

At 408, responsive to filtering the particulate with the screen, the inlet is maintained clear of the particulate. As previously described in reference to FIGS. 1 and 2A-2C, the inlets 104 of the valve body 102 are clear of particulates 208 and particulates 216. The inner sleeve 106 can move relative to the valve body 102 from the closed position to the open position to allow the fluid flow from the wellbore through the inlets 104 of the valve body 102 and moveable from the open position to the closed position to prevent the fluid flow through the inlets 104 of the valve body 102.

Figure 5:
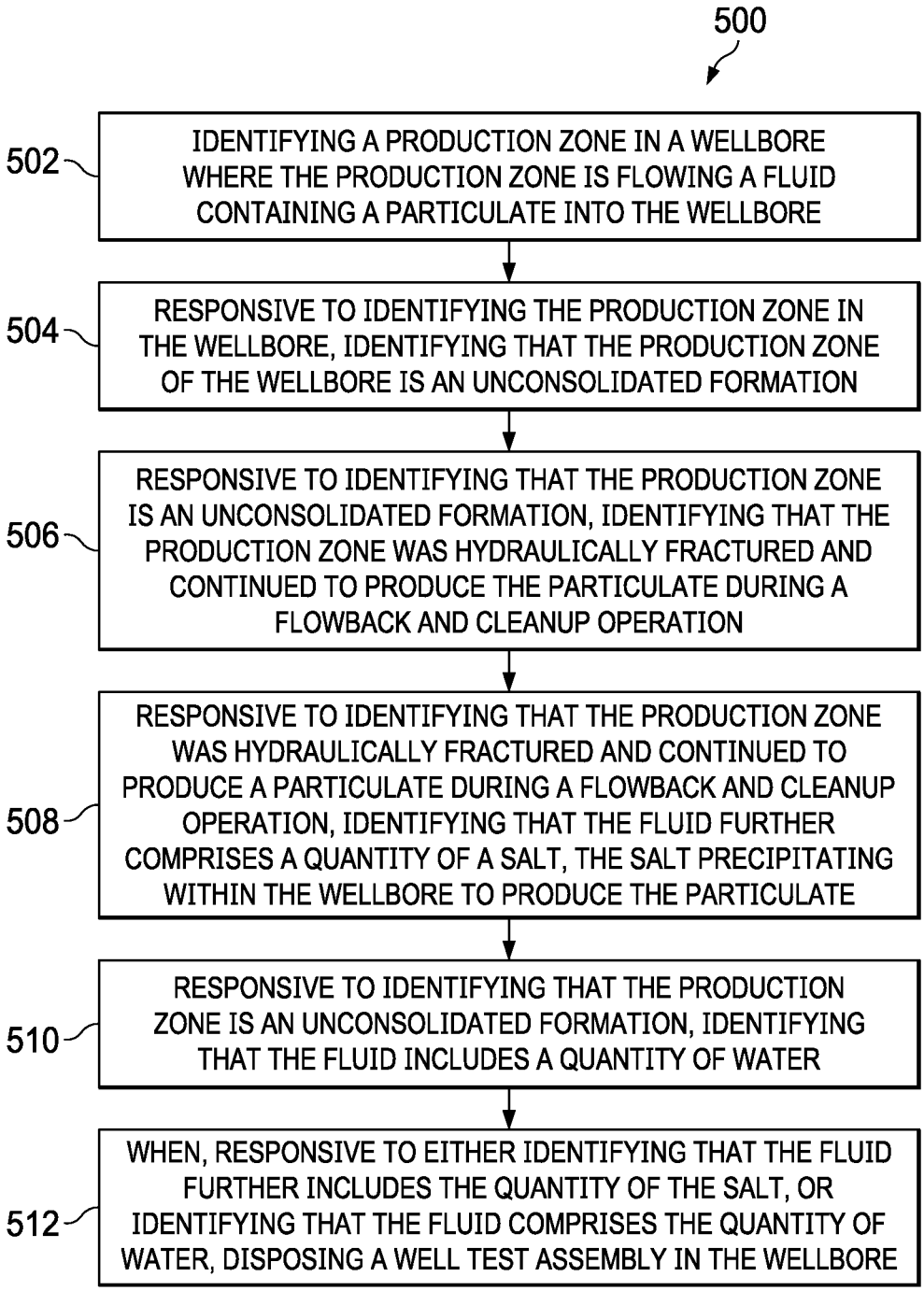
FIG. 5 illustrates a flow chart of an example method for determining that a wellbore downhole shut-in device is needed in a wellbore.

FIG. 5 illustrates a flow chart of an example method for determining that a wellbore downhole shut-in device is needed in a wellbore. At 502, a production zone in a wellbore is identified. The production zone flows a fluid containing a particulate into the wellbore. The production zone is a formation of the Earth containing a quantity of either oil or gas to be conducted to the surface of the Earth for further use such as refining into a finished product. As previously described in reference to FIGS. 2B and 2C, the fluid flow 206 containing the particulates 208. The fluid flow 206 can contain the particulates 208 and the particulates 216 of different sizes.

At 504, responsive to identifying the production zone in the wellbore, it is identified that the production zone of the wellbore is an unconsolidated formation. Identifying that production zone of the wellbore is an unconsolidated formation can include determining a rock strength of the unconsolidated formation. The production zone can be an unconsolidated formation when the rock strength of the production zone, as measured by the Young's Modulus of the formation, is less than four million pounds per square inch.

At 506, responsive to identifying that the production zone is an unconsolidated formation, it is identified that the production zone was hydraulically fractured and continued to produce the particulate during a flowback and cleanup operation. Identifying that the production zone was hydraulically fractured and continued to produce the particulate during a flowback and cleanup operation can include determining that when a production rate of the particulate from the production zone is greater than 0.2 million standard cubic feet per day that the production zone was hydraulically fractured and continued to produce the particulate during a flowback and cleanup operation. The production zone is hydraulically fractured by increasing the pressure of the fluid in the wellbore to rupture pores of the rocks in the production formation which contain the fluids and gases such as oil, hydrocarbon gases, and water. A hydraulic fracturing fluid used to hydraulically fracture the production zone can include a quantity of particulates which are injected into the wellbore and the production zone. The process of hydraulically fracturing the production zone can further increase the quantity of particulates such as sand and formation fragments in the fluid flow from the formation. The flowback and cleanup operation allows the fluids including the particulates 208 and particulates 216 from the formation to flow to surface.

At 508, responsive to identifying that the production zone was hydraulically fractured and continued to produce a particulate during a flowback and cleanup operation, it is identified that the fluid further includes a quantity of a salt. The salt precipitates within the wellbore to produce the particulate. Where the production zone includes an oil production zone, identifying that the fluid further includes the quantity of the salt can include determining that when a chloride concentration is greater than 100,000 milligrams per liter that the fluid that the salt precipitates within the wellbore. Where the production zone includes an oil production zone, identifying that the fluid further includes the quantity of the salt can include determining that when an oil produced from the oil production zone is less than 20 American Petroleum Institute gravity that the salt precipitates within the wellbore.

At 510, responsive to identifying that the production zone is an unconsolidated formation, it is identified that the fluid includes a quantity of water. Where the production zone incudes a gas production zone, identifying that the fluid includes the quantity of water includes determining that when the production zone flows greater than five barrels of water per million standard cubic feet of fluid flow from the gas production zone that the fluid includes the quantity of water. Where the production zone includes an oil production zone, identifying that the fluid includes the quantity of water includes determining that when the production zone flows greater than twenty percent water that the fluid includes the quantity of water.

At 512, when, responsive to either identifying that the fluid further includes the quantity of the salt, the salt precipitating within the wellbore to produce the particulate or identifying that the fluid comprises the quantity of water, the method can include disposing a well test assembly in the wellbore. The well test assembly includes a sensor to sense a condition of the wellbore and transmit a signal representing a value of the condition. The well test assembly includes a wellbore downhole shut-in device coupled to the sensor. The wellbore downhole shut-in device includes a valve body, an inner sleeve, an actuation mechanism, a screen, and multiple end caps. The valve body includes an inlet. The inner sleeve is coupled to an inner surface of the valve body. The inner sleeve is movable from a closed position to an open position to allow a fluid flow from the wellbore through the inlet of the valve body and moveable from the open position to the closed position to prevent the fluid flow through the inlet of the valve body. The actuation mechanism is coupled to the inner sleeve. The actuation mechanism is operable to move the inner sleeve between the closed position and the open position. The screen surrounds an outer surface of the valve body. The screen filters the particulate from the fluid flow through the inlet of the valve body. The end caps couple the screen to the valve body and the actuation mechanism.

Although the following detailed description contains many specific details for purposes of illustration, it is understood that one of ordinary skill in the art will appreciate that many examples, variations, and alterations to the following details are within the scope and spirit of the disclosure. Accordingly, the example implementations described herein and provided in the appended figures are set forth without any loss of generality, and without imposing limitations on the claimed implementations.

Although the present implementations have been described in detail, it should be understood that various changes, substitutions, and alterations can be made hereupon without departing from the principle and scope of the disclosure. Accordingly, the scope of the present disclosure should be determined by the following claims and their appropriate legal equivalents.

The invention claimed is:

1. A method comprising:

identifying a production zone in a wellbore, the production zone flowing a fluid containing a particulate into the wellbore;

responsive to identifying the production zone in the wellbore, identifying that the production zone of the wellbore is an unconsolidated formation, wherein identifying that production zone of the wellbore is an unconsolidated formation comprises determining a rock strength of the unconsolidated formation;

responsive to identifying that the production zone is an unconsolidated formation, identifying that the production zone was hydraulically fractured and continued to produce the particulate during a flowback and cleanup operation;

responsive to identifying that the production zone was hydraulically fractured and continued to produce the particulate during the flowback and cleanup operation, identifying that the fluid further comprises a quantity of a salt, the salt precipitating within the wellbore to produce the particulate;

responsive to identifying that the production zone is an unconsolidated formation, identifying that the fluid comprises a quantity of water;

when, responsive to either identifying that the fluid further comprises the quantity of the salt or identifying that the fluid comprises the quantity of water, disposing a well test assembly in the wellbore, the well test assembly comprising:

a sensor configured to sense a condition of the wellbore and transmit a signal representing a value of the condition; and a wellbore downhole shut-in device mechanically coupled to the sensor, the wellbore downhole shut-in device comprising:

a valve body comprising an inlet;

an inner sleeve coupled to an inner surface of the valve body, the inner sleeve movable from a closed position to an open position to allow a fluid flow from the wellbore through the inlet of the valve body and moveable from the open position to the closed position to stop the fluid flow through the inlet of the valve body;

an actuation mechanism coupled to the inner sleeve, the actuation mechanism operable to move the inner sleeve between the closed position and the open position;

a screen surrounding an outer surface of the valve body, the screen configured to filter the particulate from the fluid flow of the wellbore through the inlet of the valve body to reduce a quantity of the particulate in the inlet of the valve body below a predetermined threshold quantity; and a plurality of end caps configured to couple the screen to the valve body and the actuation mechanism.

2. The method of claim 1, wherein the production zone is an unconsolidated formation when the rock strength of the production zone has a Young's Modulus of less than four million pounds per square inch.

3. The method of claim 1, wherein identifying that the production zone was hydraulically fractured and continued to produce the particulate during the flowback and cleanup operation comprises determining that when a production rate of the particulate from the production zone is greater than 0.2 million standard cubic feet per day that the production zone was hydraulically fractured and continued to produce the particulate during the flowback and cleanup operation.

4. The method of claim 1, wherein the production zone comprises a gas production zone, identifying that the fluid comprises the quantity of water comprises determining that when the production zone flows greater than five barrels of water per million standard cubic feet of fluid flow from the gas production zone that the fluid comprises the quantity of water.

5. The method of claim 1, wherein the production zone comprises an oil production zone, identifying that the fluid comprises the quantity of water comprises determining that when the production zone flows comprises greater than twenty percent water that the fluid comprises the quantity of water.

6. The method of claim 1, wherein the production zone comprises an oil production zone, identifying that the fluid further comprises the quantity of the salt comprises determining that when a chloride concentration is greater than 100,000 milligrams per liter that the fluid further comprises that the salt precipitates within the wellbore.

7. The method of claim 1, wherein the production zone comprises an oil production zone, identifying that the fluid further comprises the quantity of the salt comprises determining that when an oil produced from the oil production zone is less than 20 American Petroleum Institute gravity that the salt precipitates within the wellbore.

8. The method of claim 1, wherein the condition of the wellbore is a pressure of the wellbore.

9. The method of claim 1, wherein disposing the well test assembly in the wellbore comprises, prior to disposing the well test assembly in the wellbore, verifying proper operation of the wellbore downhole shut-in device.

10. The method of claim 9, wherein verifying proper operation of the wellbore downhole shut-in device comprises:

moving the inner sleeve between the open position and the closed position;

positioning the screen surrounding the valve body; and securing the screen in place about the valve body with the plurality of end caps.

11. The method of claim 10, after securing the screen in place about the valve body with the plurality of end caps, the method further comprises:

coupling a downhole memory gauge to the wellbore downhole shut-in device by a first end cap of the plurality of end caps;

coupling a nipple-less lock to the wellbore downhole shut-in device by a second end cap of the plurality of end caps;

coupling an electronic plug setting tool to the nipple-less lock;

coupling a casing collar locator to the electronic plug setting tool;

coupling a logging head to the casing collar locator; and coupling a downhole conveyor to the logging head.

12. The method of claim 11, wherein disposing the well test assembly in the wellbore further comprises:

sensing an initial pressure of the wellbore;

positioning the well test assembly into the wellbore by the downhole conveyor;

running the well test assembly past a setting depth in the wellbore;

picking up the well test assembly, by the downhole conveyor, to the setting depth so the downhole conveyor is in tension;

measuring a final pick up weight of the well test assembly;

recording the final pick up weight;

setting the nipple-less lock to engage the well test assembly to the wellbore at the setting depth; and responsive to setting the nipple-less lock, decoupling the nipple-less lock from the electronic plug setting tool, the casing collar locator, the logging head, and the downhole conveyor, leaving the well test assembly in the wellbore.

13. The method of claim 12, after decoupling the nipple-less lock from the electronic plug setting tool, the casing collar locator, the logging head, and the downhole conveyor, the method further comprises performing a pull test to ensure that the nipple-less lock is set, the pull test comprising:

picking up, by the downhole conveyor, the electronic plug setting tool, the casing collar locator, and the logging head, off the nipple-less lock;

running the electronic plug setting tool, the casing collar locator, and the logging head back in the wellbore in a downward direction to tag the nipple-less lock;

picking up, by the downhole conveyor, the electronic plug setting tool, the casing collar locator, and the logging head, off the nipple-less lock; and pulling the electronic plug setting tool, the casing collar locator, and the logging head out of the wellbore.

14. The method of claim 13, after performing the pull test, the method further comprises performing a pressure test, the pressure test comprising:

moving the inner sleeve to the closed position;

sensing a change in wellhead pressure, wherein a decrease of wellhead pressure indicates a flow of fluids from the unconsolidated formation is decreasing, confirming that the inner sleeve is in the closed position;

shutting the wellbore at a surface of the Earth; and sensing the change in the wellhead pressure, wherein an increase in wellbore pressure indicates a leak in the wellbore downhole shut-in device.

15. The method of claim 14, further comprising sensing the change in the wellhead pressure for one hour, wherein the increase in wellbore pressure for one hour indicates the leak in the wellbore downhole shut-in device.

16. The method of claim 14, wherein the pressure test further comprises:

opening the wellbore downhole shut-in device;

equalizing a differential pressure between the wellbore and the wellbore downhole shut-in device; and after the differential pressure is equalized, fully opening the wellbore downhole shut-in device.

17. The method of claim 16, wherein a differential pressure between the wellbore and the wellbore downhole shut-in device is equalized when a pressure is equal to the initial pressure of the wellbore.

18. The method of claim 16, further comprising, recording, by the downhole memory gauge, the change in wellhead pressure.

19. The method of claim 1, further comprising:

receiving the fluid flow of the wellbore, the fluid flow comprising the particulate, at the screen of the wellbore downhole shut-in device;

flowing the fluid comprising the particulate through the screen;

filtering the particulate with the screen; and responsive to filtering the particulate with the screen, maintaining the inlet of the valve body clear of the particulate.

20. The method of claim 1, wherein the screen comprises:

a first screen configured to filter a first particulate size; and a second screen coupled to the first screen positioned inward from the first screen towards the valve body, the second screen configured to filter a second particulate size, the second particulate size smaller than the first particulate size.

* * * * *